US006244917B1

(12) United States Patent
Hartke et al.

(10) Patent No.: US 6,244,917 B1
(45) Date of Patent: Jun. 12, 2001

(54) FUEL DELIVERY SYSTEM FOR A BOAT

(75) Inventors: David J. Hartke, Gurnee; Richard P. Kolb, Prairie View, both of IL (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/425,431

(22) Filed: Oct. 22, 1999

(51) Int. Cl.[7] ..... B63H 21/38

(52) U.S. Cl. ..... 440/88; 123/468; 123/514; 123/518

(58) Field of Search ..... 440/88; 123/468, 123/514, 518

(56) References Cited

U.S. PATENT DOCUMENTS 4,416,638 * 11/1983 Ellis ..... 440/88
4,722,708 2/1988 Baltz .
4,809,666 3/1989 Baltz .
5,076,242 * 12/1991 Parker ..... 123/514
5,598,827 * 2/1997 Kato ..... 123/518

* cited by examiner

*Primary Examiner*—Sherman Basinger
(74) *Attorney, Agent, or Firm*—Enrique J. Mora; Robert W. Duckworth; Holland & Knight LLP

(57) ABSTRACT

A fuel delivery system for a boat having an internal combustion engine is provided. The system provides a source of fuel. A fuel supply conduit is connected to the source of fuel to deliver fuel to the engine. A fuel impermeable housing has one end coupled to the source of fuel and defines a passageway that receives the fuel supply conduit interiorly of the boat. The passageway is hermetically sealed relative to the interior of the boat and provides a return path into the fuel source to any fuel that may spill in the passageway.

45 Claims, 4 Drawing Sheets

FUEL DELIVERY SYSTEM FOR A BOAT

BACKGROUND OF THE INVENTION

The invention relates to fuel delivery systems, and more particularly, to marine fuel delivery systems including a fuel tank inside a boat, and means for supplying fuel from the fuel tank to the engine of a marine propulsion device mounted on the boat. through the fuel distribution system. This negative pressure, however, can cause the fuel to vaporize in the fuel supply line. The result can be inability of the fuel distribution system to supply liquid fuel to the engine at a given fuel flow rate due to excessive fuel vapor generation, often referred to as vapor lock.

A known method of preventing vapor lock is to pump the fuel under pressure through the fuel distribution system to the engine. Pumping the fuel under pressure will eliminate the tendency of the fuel to vaporize because it is at a positive pressure. However, leakage of a pressurized fuel line would allow fuel to leak into the bilge of a boat.

Attention is directed to Ellis U.S. Pat. No. 4,416,638, issued Nov. 22, 1983, which discloses a fuel distribution system including a casing surrounding the upstream portion of a gas feed pipe between the boat transom and the carburetor of the engine. The casing is not connected to the source of fuel and does not surround the entire portion of the fuel pipe located interiorly of the boat.

Attention is further directed to Baltz U.S. Pat. No. 4,722,708 that is assigned to the assignee of the present invention and is herein incorporate by reference. As further described below, the Baltz patent advantageously overcomes the drawbacks of the foregoing Ellis patent. It would be desirable, however, to provide a return path to the fuel source to any fuel that could spill within a housing that surrounds the portion of any fuel conduit located interiorly of the boat. It would be further desirable to prevent fuel flow from the fuel tank into the housing, such as could occur during an overflow condition of the fuel tank. It would also be desirable to provide a marine propulsion system that uses a reliable and user-friendly installation kit that safely and economically allows for relatively quick maintenance and substantially trouble-free operation of the fuel delivery system therein.

BRIEF SUMMARY OF THE INVENTION

Generally speaking the present invention fulfills the foregoing needs by providing a fuel delivery system for a boat having an engine. The system provides a source of fuel. A fuel supply conduit is connected to the source of fuel to deliver fuel to the engine. A fuel impermeable housing has a proximate end coupled to the source of fuel and defines a passageway that receives the fuel supply conduit interiorly of the boat. The passageway is hermetically sealed relative to the interior of the boat and provides a return path into the fuel source to any fuel that may spill in the passageway.

The present invention further fulfills the foregoing needs by providing a marine propulsion system, such as an outboard propulsion system, in a boat having a transom including an opening. The propulsion system includes a propulsion unit mounted exteriorly of the transom and including an engine. A source of fuel is located interiorly of the boat. A fuel supply conduit is connected between the source of fuel and the engine and has a section located interiorly of the boat. A fuel impermeable housing is connected to the source of fuel and defines a sealed passageway relative to the interior of the boat. The passageway receives that section of the supply conduit and provides a return path into the fuel source to any fuel that may spill therein. An interface assembly is provided to connect the housing to the transom of the boat so that the passageway defined by the housing is in communication with the transom opening. A vent is provided to communicate with the passageway defined by the housing to vent any fuel vapors from the fuel source to the exterior of the boat.

The present invention still further fulfills the foregoing needs by providing a marine propulsion system, such as a stern drive, in a boat having a transom. The propulsion system in this case includes an engine mounted interiorly of the boat. A propulsion unit is mounted on the boat exteriorly of the transom. A source of fuel is located interiorly of the boat. A fuel supply conduit extends interiorly of the boat and communicates between the source of fuel and the engine. A fuel impermeable housing is connected to the source of fuel and defines a sealed passageway relative to the interior of the boat. The passageway receives the fuel supply conduit and provides a return path into the fuel source to any fuel that may spill therein. Means for venting the passageway including a conduit communicating the passageway with the engine for venting any fuel vapors therein into the engine. Alternatively, the conduit could communicate with the exterior of the boat so as to vent any fuel vapors to the exterior of the boat.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
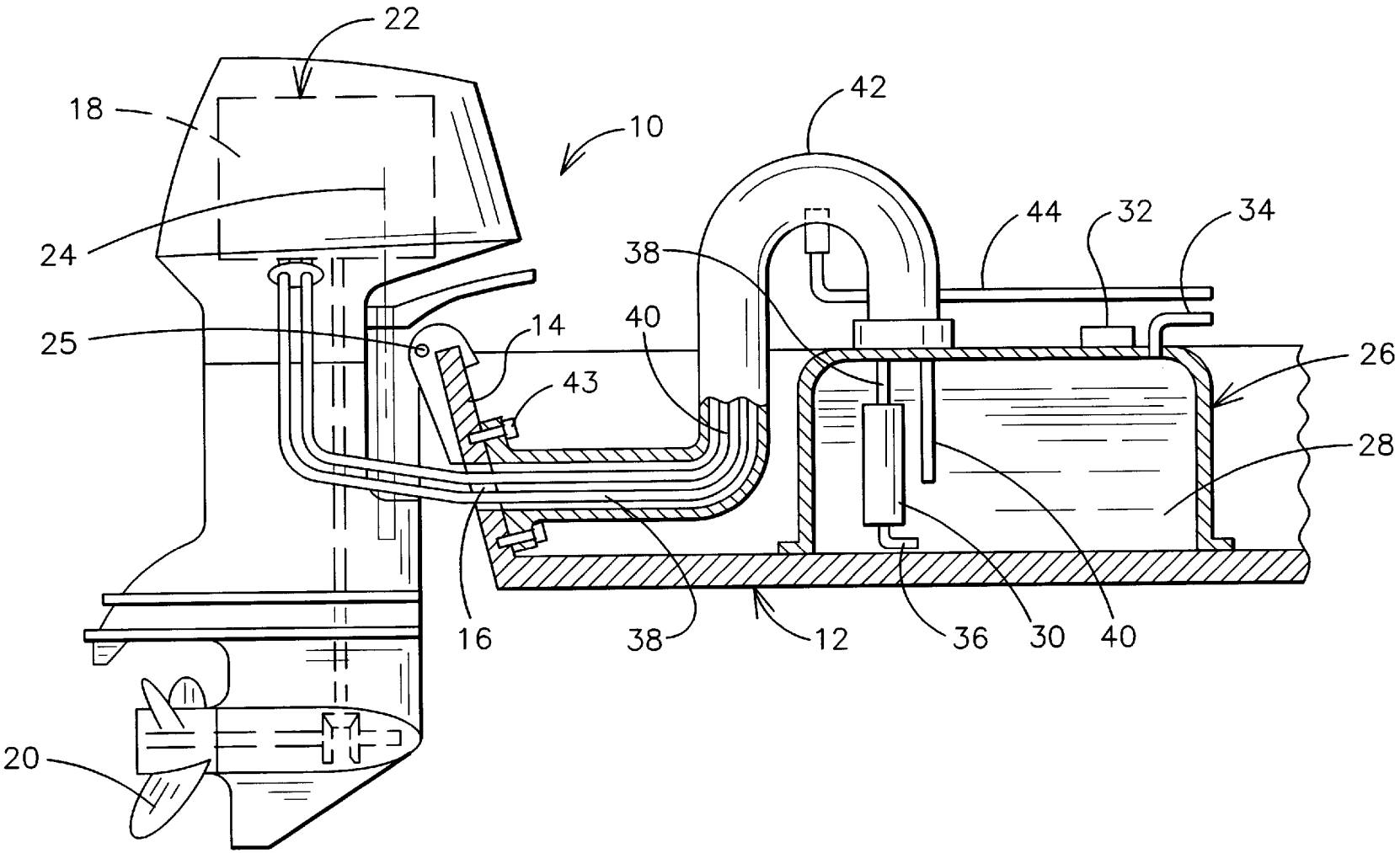
FIG. 1 PRIOR ART
FIG. 1 is a side elevational view, partially in cross section, of a prior art marine propulsion installation.

FIG. 1 is a partially schematic view of a prior art marine propulsion system 10 in a boat 12 having an interior, an exterior, and a transom 14 having an opening 16 therein. The system 10 includes a marine propulsion device including an engine 18, and a rotatably mounted propeller 20 driven by the engine 18. As shown in FIG. 1, the marine propulsion device is an outboard motor 22 pivotally mounted on the exterior of the transom 14 for pivotal movement relative to the transom 14 about a generally vertical steering axis 24, and about a generally horizontal tilt axis 25.

The marine propulsion system 10 also includes a source of fuel located interiorly of the boat 12. The source of fuel includes a conventional fuel tank 26 having an exterior and including a fuel chamber 28, and a pump 30 that may be mounted interiorly of the fuel tank 26 within the fuel chamber 28. The fuel tank 26 also includes a removable fill cap 32, and a conduit 34 venting the fuel chamber 28 to the exterior of the boat 12. In the illustrated construction, the pump 30 is a submersible electric pump equipped with a fuel filter 36 which reaches to the bottom of the fuel chamber 28.

The marine propulsion system 10 also comprises supply conduit means communicating between the fuel tank 26 and the engine 18 and having a portion located interiorly of the boat 12. The supply conduit means includes a flexible supply conduit 38 extending through the opening 16 in the transom 14 and communicating between the pump 30 and the engine 18. The pump 30 delivers fuel under pressure through the supply conduit 38 to the engine 18.

The marine propulsion system 10 may further comprise return conduit means communicating between the engine 18 and the fuel chamber 28 of the fuel tank 26 and having a portion located interiorly of the boat 12. The return conduit means returns fuel not consumed by the engine 18 to the fuel chamber 28. The return conduit means includes a flexible return conduit 40 communicating between the engine 18 and the fuel chamber 28.

The marine propulsion system 10 includes a fuel impermeable housing connected to the exterior of the fuel tank 26 and surrounding the portions of the supply and return conduits 38 and 40 located interiorly of the boat 12. The housing is a housing conduit 42 that is sealingly connected to the exterior of the fuel tank 26 so as to prevent communication between the housing conduit 42 and the interior of the boat 12, and between the housing conduit 42 and the fuel chamber 28. The end of the housing conduit 42 is closed, except for two openings through which the supply and return conduits 38 and 40 extend, and only the supply and return conduits 38 and 40 communicate with the fuel chamber 28. The housing conduit 42 surrounds the portions of the supply and return conduits 38 and 40 extending between the fuel tank 26 and the transom 14.

The marine propulsion system 10 further includes means for sealingly connecting the housing conduit 42 to the interior of the transom 14 in communication with the opening 16 in the transom 14 so as to prevent communication between the housing conduit 42 and interior of the boat 12. In the construction shown in FIG. 1, the aft end of the housing conduit 42 includes an annular flange, and the sealing means includes screws 43 securing the flange to the transom 14. Thus, the ends of the housing conduit 42 are sealingly connected to the fuel tank 26 and to the interior of the transom 14, so that any fuel leaking into the housing conduit 42 cannot leak into the interior of the boat 12. It is noted that housing conduit 42 does not allow for any fuel that may spill therein to return into fuel chamber 28.

Figure 2:
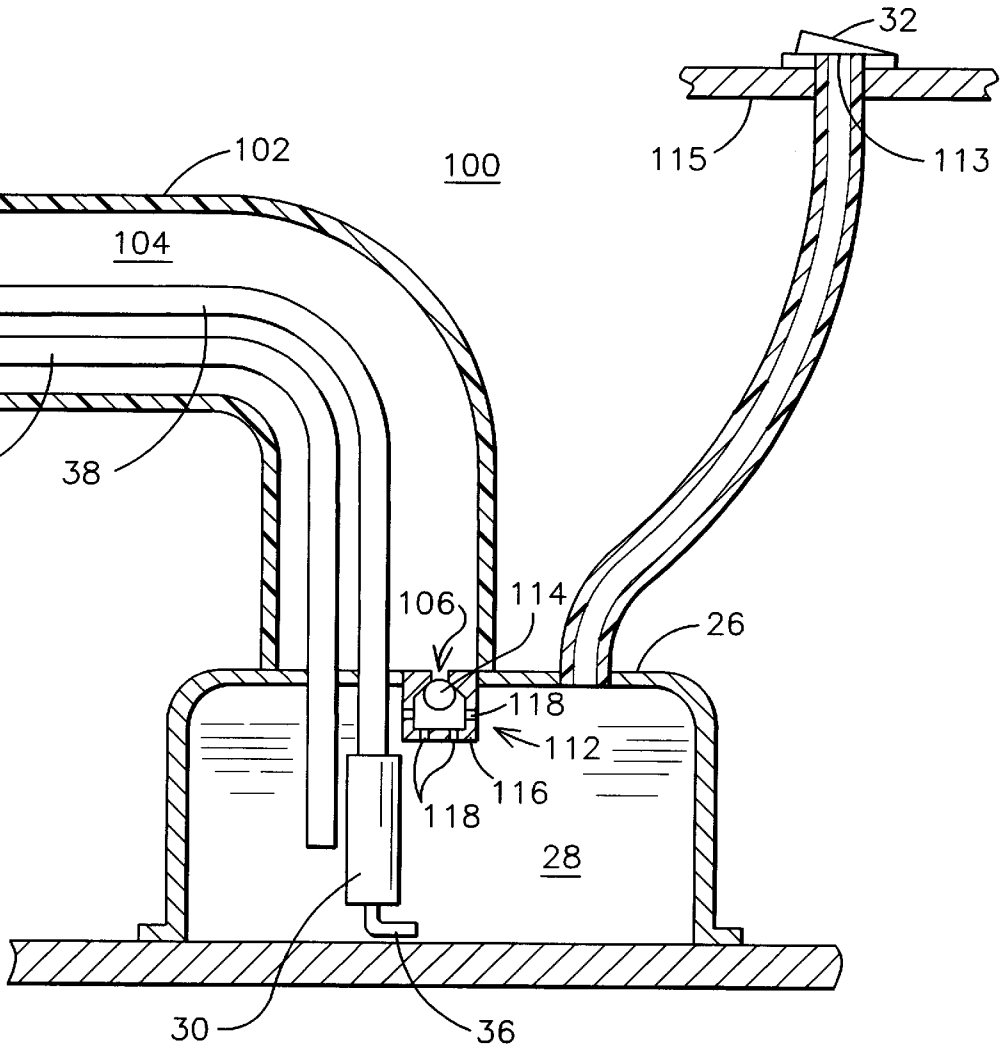
FIG. 2 is a side elevational view, partially in cross section, of an exemplary marine propulsion installation using an embodiment of the fuel delivery system of the present invention that illustrates among other things a valve in an overflow condition.

FIG. 2 is a partially schematic view of an exemplary embodiment of the fuel delivery system 100 of the present invention. As shown in FIG. 2, a substantially fuel-impermeable housing 102 defines a passageway 104 that receives the fuel supply conduit 38 interiorly of the boat. By way of example, impermeable housing 102 may be a USCG Type A1 hose or other hose that meets the various performance requirements of 33 CFR 183, including any permeation rating set forth therein. Passageway 104 may further receive return conduit 40, in the event such return conduit is used in a given fuel delivery installation. It will be appreciated that the embodiment of FIG. 2 shows a fuel distribution system for a single fuel tank and a single engine. It will be understood, however, that the fuel distribution system of the present invention need not be limited to single engine or single fuel tank installation since housing 102 could be readily chosen to have a sufficiently large inner diameter so as to accommodate any additional conduits that may be required in a multi-engine and/or multi-tank implementation.

In one key feature of the present invention, housing 102 is configured to communicate with the fuel tank through an opening 106 that normally allows for venting the fuel chamber through passageway 104 which in turn communicates with the exterior of the boat through a vent 108 that may be located in an interface assembly 110 mounted in the transom opening or other suitable wall opening in the boat. In another key feature of the present invention, it will be appreciated that in the event any of the fuel conduits therein were to develop a fuel leak, any fuel that spills within passageway 104 will advantageously return into fuel chamber 28 since housing 102 is configured to provide a return path to any fuel that could spill from the fuel conduits 38 or 40.

As further shown in FIG. 2, opening 106, in order to prevent flow of fuel from fuel tank 26 into passageway 104, may include a shut-off valve 112 that normally allows for communication between the fuel chamber 28 and passageway 104. In the exemplary embodiment of FIG. 2, valve 112 has a floater ball 114 within a suitable encasing 116 that has a plurality of perforations that allow for passing fuel therethrough so that in the event of a fuel overflow condition, ball 114 will rise so as to seal opening 106 and thereby prevent overflow of fuel into passageway 104. As specifically shown in FIG. 2, valve 112 shows floater ball 114 in an overflow condition, that is, in response to the presence of fuel, ball 114 rises to hermetically seal opening 106. It will be appreciated by those skilled in the art, that a valve using a floater ball design is merely exemplary since other valve designs could be readily employed in valve 112, such as disc or proper valve design, using readily understood valve construction techniques. It will be further appreciated by those skilled in the art, that valve 112 is conveniently used preferably in installations where the fuel fill opening 113, such as may be made in the deck 115 of the boat, is located higher than vent 108 since in installations where the fuel fill opening is located lower than vent 108, use of valve 112 would not be required.

Figure 3:
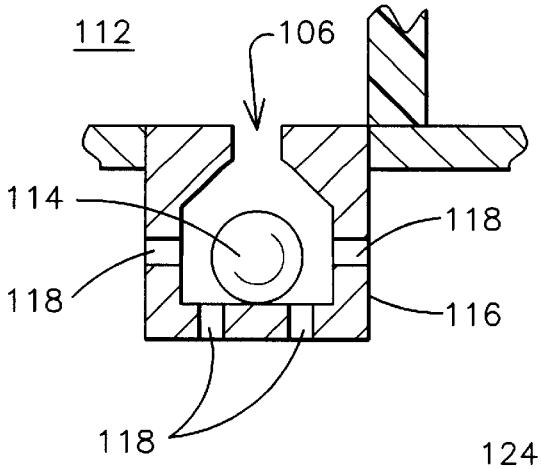
FIG. 3 shows the valve of FIG. 3 in a non-overflow condition.

FIG. 3 shows the ball floater 114 of valve 112 during a non-overflow condition, that is, the floater ball is not surrounded by fuel and rests against encasing 116. As suggested above, valve 112 in the non-overflow condition allows for communication through opening 106 between passageway 104 and fuel chamber 28.

Figure 4:
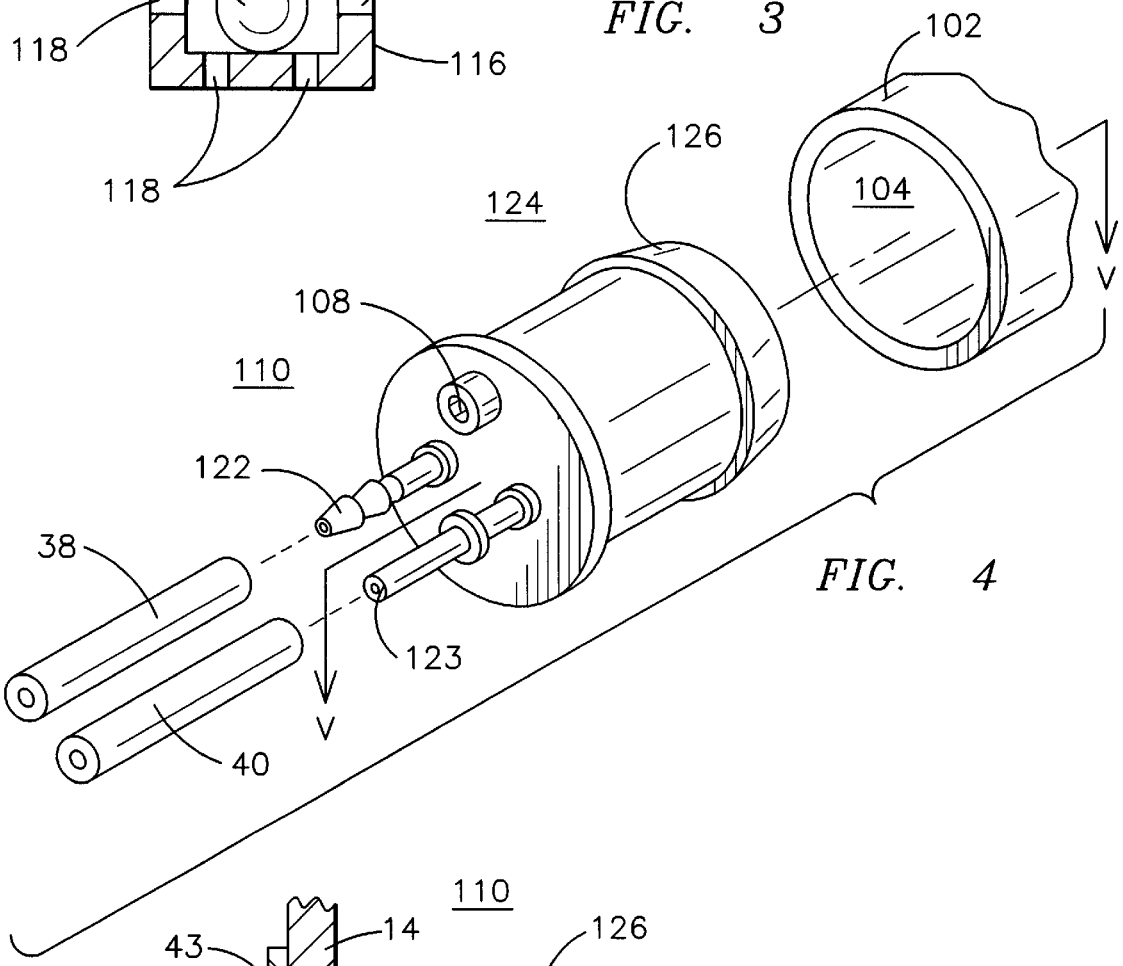
FIG. 4 is an exploded and isometric view of an exemplary interface assembly for the fuel delivery system of FIG. 2 that may be mounted through the transom or other suitable wall of the boat.

FIG. 4 shows a partially exploded isometric view of interface assembly 110 wherein, as previously suggested, vent 108 allows for communication between the exterior of the boat and passageway 104. Assembly 110 includes a first fitting 122 that allows for interconnecting the fuel supply conduit 38 between the engine and the fuel source. Assembly 110 further includes a second fitting 123 that allows for interconnecting the return conduit 40 between the engine and the fuel source. Assembly 110 further includes a receptacle section 124 for sealingly receiving housing 102. By way of example and not of limitation, receptacle section 124 may include a barb 126 to prevent housing 102 from being disengaged from receptacle section 124. Similarly, first fitting 122 may include a plurality of barbs 128 that allow for securely coupling conduit 38 to fitting 122. It will be appreciated that other fitting configurations may be readily used in interface assembly 110. For example, second fitting 123 is illustrated as a quick interface fitting that does not employ barbs to secure conduit 40. Thus it will be appreciated that the present invention is not limited to any particular type of interface fittings, since either barbed or quick disconnect fittings may be used equally conveniently. By way of example, the fuel conduits may be made from flexible metal, rubber or nylon tubing or any other material suitable for fuel line applications.

Figure 5:
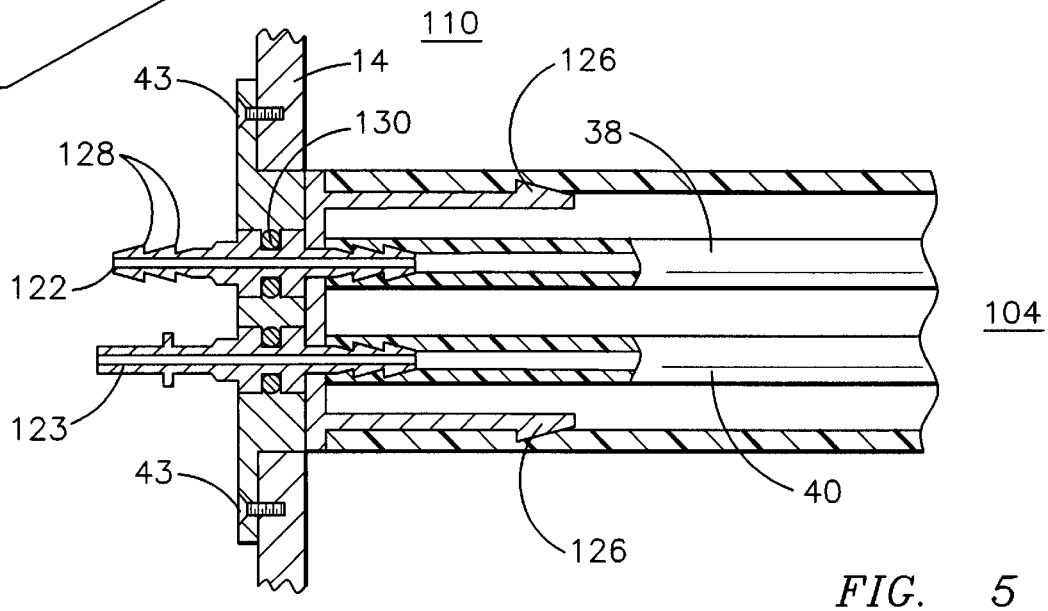
FIG. 5 is a cross-sectional view along line V—V of the interface assembly shown in FIG. 4.

FIG. 5 shows a cross sectional view of interface assembly 110 along reference line V—V, in FIG. 4. As illustrated in FIG. 5, interface assembly 110 may include "0" rings 130 that allow for preventing the entry of water into passageway 104.

Figure 7:
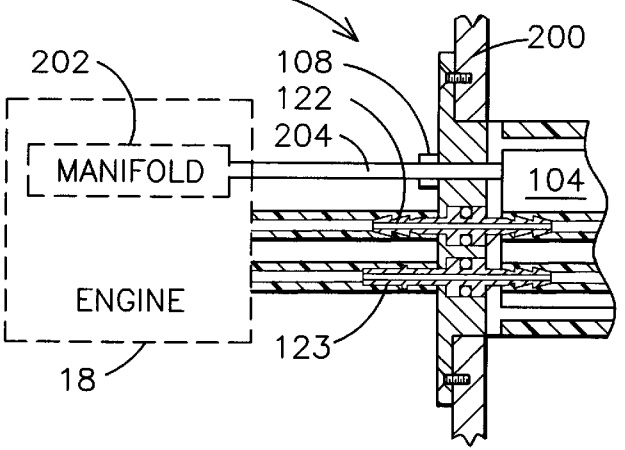
FIG. 7 shows an embodiment of the fuel delivery system that in another aspect of the present invention allows for venting fuel vapor into a manifold of the engine.

It will be appreciated by those skilled in the art, as shown in FIG. 7, that interface assembly 110 need not be mounted on the transom opening since in the case of a stern drive or inboard/outboard installation, the engine will be mounted inside the boat 12 and thus in such installation, the interface assembly could be mounted, for example, in an opening in a predetermined wall of the boat, such as a wall 200 of the engine compartment. Thus, it will be understood that the present invention is not limited to outboard systems, since a stern drive could also benefit from the teachings of the present invention. For additional background information in connection with a fuel distribution system adapted for a stern drive application see the foregoing Baltz patent. It will be appreciated that since the engine may generally include a vacuum source, such as an intake manifold 202, in case the engine 18 is mounted interiorly on the boat, a conduit 204 could be readily used for communicating vent 108 into the intake manifold of the engine in order to vent any fuel vapors in passageway 104 into the engine.

Figure 6:
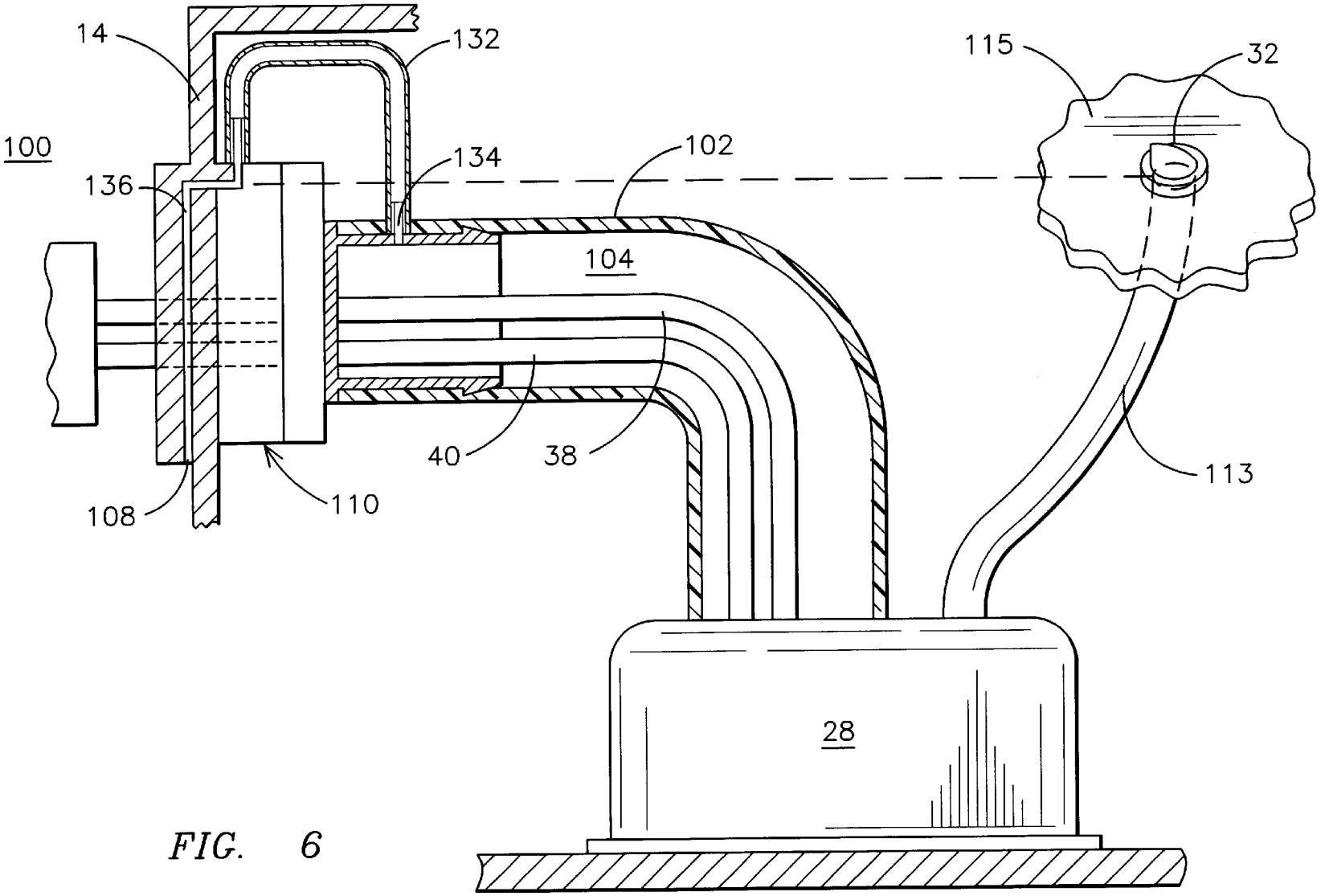
FIG. 6 is a side elevational view, partially in cross section, of another embodiment of the fuel delivery system of the present invention that illustrates among other things a conduit for preventing entry of water into the interior of a housing for the fuel delivery system.

FIG. 6 shows an exemplary embodiment of the fuel distribution system that allows for preventing entry of water into passageway 104 through vent 108. By way of example, an arcuate conduit 132 in communication with passageway 104 through an opening 134 in housing 102 at one end thereof. Conduit 132 communicates at its other end through vent 108 with the exterior of the boat by way of a respective channel 136 in interface assembly 110. It will be understood that other constructions may be conveniently employed to prevent intrusion of water through vent 108. For example, in lieu of conduit 132, a water and/or moisture trapping labyrinth could be readily constructed within interface assembly 110 using techniques well understood by those skilled in the art. The fuel distribution system of the present invention allows for providing a relatively simple installation kit that permits quick and reliable, yet inexpensive, maintenance and/or servicing operations in the boat.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A fuel delivery system for a boat having an engine, the system comprising:

a source of fuel;

a fuel supply conduit connected to the source of fuel to deliver fuel to the engine; and a fuel impermeable housing having a proximate end coupled to the source of fuel to define a passageway that receives the fuel supply conduit interiorly of the boat, the passageway being hermetically sealed relative to the interior of the boat and providing a return path into the fuel source to any fuel that may spill in the passageway.

2. The fuel system of claim 1 wherein the housing has a distal end relative to the fuel source coupled to a respective interface assembly.

3. The fuel system of claim 2 wherein the interface assembly is mounted through an opening in the transom of the boat.

4. The fuel system of claim 2 wherein the interface assembly is mounted through an opening in a predetermined wall of the boat.

5. The fuel system of claim 2 wherein the interface assembly has a first fitting configured to interconnect the fuel supply conduit between the engine and the fuel source.

6. The fuel system of claim 2 further comprising a fuel return conduit communicating between the engine and the source of fuel and wherein the housing also sealingly encloses the return conduit relative to the interior of the boat.

7. The fuel system of claim 6 wherein the interface assembly has a second fitting configured to interconnect the return conduit between fuel source and the engine.

8. The fuel system of claim 2 further comprising a vent configured to vent the passageway to the exterior of the boat.

9. The fuel system of claim 8 wherein the vent is located at the interface assembly.

10. The fuel system of claim 1 further comprising a gas tank having a fuel chamber.

11. The fuel system of claim 10 further comprising means for venting the fuel chamber through the passageway to the exterior of the boat.

12. A fuel delivery system for a boat having an engine, the system comprising:

a source of fuel including a gas tank having a fuel chamber;

a fuel supply conduit connected to the source of fuel to deliver fuel to the engine;

a fuel impermeable housing having a proximate end coupled to the source of fuel to define a passageway that receives the fuel supply conduit interiorly of the boat, the passageway being hermetically sealed relative to the interior of the boat and providing a return path into the fuel source to any fuel that may spill in the passageway; and means for venting the fuel chamber through the passageway to the exterior of the boat wherein the means for venting the fuel chamber has a valve that prevents passage of fuel into the passageway during any overflow condition of the fuel chamber.

13. A marine propulsion system in a boat having a transom including an opening, the propulsion system comprising:

a propulsion unit mounted exteriorly of the transom and including an engine;

a source of fuel located interiorly of the boat;

a fuel supply conduit connected between the source of fuel and the engine and having a section located interiorly of the boat;

a fuel impermeable housing connected to the source of fuel and defining a sealed passageway relative to the interior of the boat, the passageway receiving said section of the supply conduit and providing a return path into the fuel source to any fuel that may spill therein;

an interface assembly configured to connect the housing to the transom of the boat so that the passageway defined by the housing is in communication with the transom opening; and a vent configured to communicate with the passageway defined by the housing to vent any fuel vapors from the fuel source to the exterior of the boat.

14. The marine propulsion system as set forth in claim 13 wherein the vent communicates the passageway to the exterior of the boat through the transom opening.

15. The marine propulsion system as set forth in claim 13 wherein the source of fuel includes a fuel tank having an exterior and including a fuel chamber, and wherein the housing is sealingly connected relative to the exterior of the fuel tank so as to prevent communication between the passageway and the interior of the boat.

16. The fuel system of claim 15 wherein the interface assembly has a first fitting configured to interconnect the fuel supply conduit between the engine and the fuel source.

17. The marine propulsion system as set forth in claim 13 wherein the source of fuel includes a fuel tank having a fuel chamber, and wherein the source of fuel further includes a pump communicating with the fuel chamber and with the fuel supply conduit.

18. The marine propulsion system of claim 17 further comprising means for venting the fuel chamber through the passageway to the exterior of the boat.

19. The marine propulsion system as set forth in claim 13 and further comprising a return conduit communicating between the engine and the source of fuel and having a portion thereof located interiorly of the boat, and wherein the housing also encloses that portion of the return conduit.

20. The fuel system of claim 19 wherein the interface assembly has a second fitting configured to interconnect the return conduit between fuel source and the engine.

21. The marine propulsion system of claim 13 wherein the vent is located at the interface assembly.

22. A marine propulsion system in a boat having a transom including an opening, the propulsion system comprising:

a propulsion unit mounted exteriorly of the transom and including an engine;

a source of fuel located interiorly of the boat, said fuel source including a fuel tank having a fuel chamber;

a fuel supply conduit connected between the source of fuel and the engine and having a section located interiorly of the boat;

a fuel impermeable housing connected to the source of fuel and defining a sealed passageway relative to the interior of the boat, the passageway receiving said section of the supply conduit and providing a return path into the fuel source to any fuel that may spill therein;

an interface assembly configured to connect the housing to the transom of the boat so that the passageway defined by the housing is in communication with the transom opening;

a vent configured to communicate with the passageway defined by the housing to vent any fuel vapors from the fuel source to the exterior of the boat; and means for venting the fuel chamber through the passageway to the exterior of the boat, wherein the means for venting the fuel chamber has a valve that prevents passage of fuel into the passageway during any overflow condition of the fuel chamber.

23. A marine propulsion system in a boat having a transom, the system comprising:

an engine mounted interiorly of the boat;

a propulsion unit mounted on the boat exteriorly of the transom;

a source of fuel located interiorly of the boat;

a fuel supply conduit extending interiorly of the boat and communicating between the source of fuel and the engine;

a fuel impermeable housing connected to the source of fuel and defining a sealed passageway relative to the interior of the boat, the passageway receiving the fuel supply conduit and providing a return path into the fuel source to any fuel that may spill therein; and means for venting the passageway including a conduit communicating the passageway with the engine for venting any fuel vapors therein into the engine.

24. The marine propulsion system as set forth in claim 23 wherein the engine includes a vacuum source, and wherein the means for venting the passageway includes a conduit communicating between the vacuum source and a respective passageway portion substantially adjacent the engine.

25. The marine propulsion system as set forth in claim 23 wherein the means for venting includes means communicating with a respective passageway portion substantially adjacent the source of fuel for venting the passageway to the exterior of the boat.

26. The marine propulsion system as set forth in claim 23 wherein the source of fuel includes a fuel tank having an exterior and including a fuel chamber, and wherein the housing is sealingly connected to the exterior of the fuel tank so as to prevent communication between the passageway and the interior of the boat.

27. The marine propulsion system of claim 26 further comprising a vent for venting the fuel chamber through the passageway to the exterior of the boat or into the interior of the engine.

28. The marine propulsion of system of claim 27 wherein the vent for venting the fuel chamber has a valve that prevents passage of fuel into the passageway during any overflow condition of the fuel chamber.

29. A marine propulsion system as set forth in claim 23 wherein the source of fuel includes a fuel tank including a fuel chamber, and wherein the source of fuel further includes a pump mounted on the fuel tank and communicating with the fuel chamber and with the supply conduit.

30. The marine propulsion system as set forth in claim 23 and further comprising a return conduit from the engine to the source of fuel, and wherein the housing also encloses the return conduit.

31. A kit for a boat having an engine, the kit comprising:

a source of fuel;

a fuel supply conduit connected to the source of fuel to deliver fuel to the engine; and a fuel impermeable housing having a proximate end coupled to the source of fuel to define a passageway that receives the fuel supply conduit interiorly of the boat, the passageway being hermetically sealed relative to the interior of the boat and providing a return path into the fuel source to any fuel that may spill in the passageway.

32. The kit of claim 31 wherein the housing has a distal end relative to the fuel source coupled to a respective interface assembly.

33. The kit of claim 32 wherein the interface assembly is mounted through an opening in the transom of the boat.

34. The kit of claim 33 wherein the interface assembly is mounted through an opening in a predetermined wall of the boat.

35. The kit of claim 32 wherein the interface assembly has a first fitting configured to interconnect the fuel supply conduit between the engine and the fuel source.

36. The kit of claim 32 further comprising a fuel return conduit communicating between the engine and the source of fuel and wherein the housing also sealingly encloses the return conduit relative to the interior of the boat.

37. The kit of claim 36 wherein the interface assembly has a second fitting configured to interconnect the return conduit between fuel source and the engine.

38. The kit of claim 32 further comprising a vent configured to vent the passageway to the exterior of the boat.

39. The kit of claim 38 wherein the vent is located at the interface assembly.

40. The kit of claim 31 further comprising a gas tank having a fuel chamber.

41. The kit of claim 40 further comprising means for venting the fuel chamber through the passageway to the exterior of the boat.

42. A kit for a boat having an engine, the kit comprising:

a source of fuel including a gas tank and having a fuel chamber;

a fuel supply conduit connected to the source of fuel to deliver fuel to the engine;

a fuel impermeable housing having a proximate end coupled to the source of fuel to define a passageway that receives the fuel supply conduit interiorly of the boat, the passageway being hermetically sealed relative to the interior of the boat and providing a return path into the fuel source to any fuel that may spill in the passageway; and means for venting the fuel chamber through the passageway to the exterior of the boat, wherein the means for venting has a valve that prevents passage of fuel into the passageway during any overflow condition of the fuel chamber.

43. A fuel delivery system for a boat having an engine, the system comprising:

a source of fuel including a gas tank having a fuel chamber;

a fuel supply conduit connected to the source of fuel to deliver fuel to the engine;

a fuel impermeable housing having a proximate end coupled to the source of fuel to define a passageway that receives the fuel supply conduit interiorly of the boat, the passageway being hermetically sealed relative to the interior of the boat and providing a return path into the fuel source to any fuel that may spill in the passageway; and a vent configured to vent the fuel chamber through the passageway to the exterior of the boat, said vent including a valve that prevents passage of fuel into the passageway during any overflow condition of the fuel chamber.

44. A marine propulsion system in a boat having a transom including an opening, the propulsion system comprising:

a propulsion unit mounted exteriorly of the transom and including an engine;

a source of fuel located interiorly of the boat, said fuel source including a fuel tank having a fuel chamber;

a fuel supply conduit connected between the source of fuel and the engine and having a section located interiorly of the boat;

a fuel impermeable housing connected to the source of fuel and defining a sealed passageway relative to the interior of the boat, the passageway receiving said section of the supply conduit and providing a return path into the fuel source to any fuel that may spill therein;

an interface assembly configured to connect the housing to the transom of the boat so that the passageway defined by the housing is in communication with the transom opening;

a first vent configured to communicate with the passageway defined by the housing to vent any fuel vapors from the fuel source to the exterior of the boat; and a second vent configured to vent the fuel chamber through the passageway to the exterior of the boat, said vent including a valve that prevents passage of fuel into the passageway during any overflow condition of the fuel chamber.

45. A kit for a boat having an engine, the kit comprising:

a source of fuel including a gas tank and having a fuel chamber;

a fuel supply conduit connected to the source of fuel to deliver fuel to the engine;

a fuel impermeable housing having a proximate end coupled to the source of fuel to define a passageway that receives the fuel supply conduit interiorly of the boat, the passageway being hermetically sealed relative to the interior of the boat and providing a return path into the fuel source to any fuel that may spill in the passageway; and a vent configured to vent the fuel chamber through the passageway to the exterior of the boat, said vent including a valve that prevents passage of fuel into the passageway during any overflow condition of the fuel chamber.

* * * * *